US006796231B2

(12) United States Patent
Van Denend et al.

(10) Patent No.: US 6,796,231 B2
(45) Date of Patent: Sep. 28, 2004

(54) SHIELD FOR DOCTOR BLADE HOLDER

(75) Inventors: Mark E. Van Denend, Paterson, NJ (US); Larry Van Denend, Parker, CO (US)

(73) Assignee: The Provident Group, Paterson, NJ (US)

( * ) Notice: Subject to any disclaimer, the term of this patent is extended or adjusted under 35 U.S.C. 154(b) by 0 days.

(21) Appl. No.: 10/251,351

(22) Filed: Sep. 20, 2002

(65) Prior Publication Data

US 2004/0055488 A1 Mar. 25, 2004

(51) Int. Cl.[7] ..... B41F 31/07
(52) U.S. Cl. ..... 101/350.6; 101/169
(58) Field of Search ..... 101/350.6, 350.1, 101/363, 364, 366, 157, 160, 425

(56) References Cited

U.S. PATENT DOCUMENTS 2,180,785 A * 11/1939 Wickwire, Jr. ..... 101/157
3,521,561 A * 7/1970 Pali et al. ..... 101/169
3,986,453 A * 10/1976 Boose ..... 101/169
4,406,224 A * 9/1983 Hajek ..... 101/363

* cited by examiner

*Primary Examiner*—Andrew H. Hirshfeld
*Assistant Examiner*—Leo T. Hinze
(74) *Attorney, Agent, or Firm*—Richard M. Goldberg

(57) ABSTRACT

For use with an ink chamber housing of a printing machine, a combination includes a doctor blade adapted to be secured to the ink chamber housing so as to extend outwardly therefrom, the doctor blade including a doctoring plate having a rear portion to be secured to the ink chamber housing and a front doctoring edge in contact with the outer surface of the roll to meter ink thereto, and a chamber doctor blade shield having one end fixed to the doctor blade in spaced relation from the doctoring edge and a second opposite free end unsecured to the doctoring plate, so as to cover the outer surface of the ink chamber housing to prevent ink from depositing thereon when the combined doctor blade and chamber doctor blade shield is clamped to the chamber housing.

25 Claims, 2 Drawing Sheets

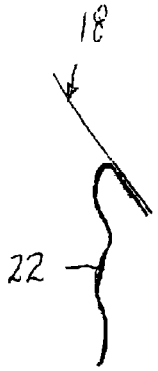
FIG. 3
FIG. 4
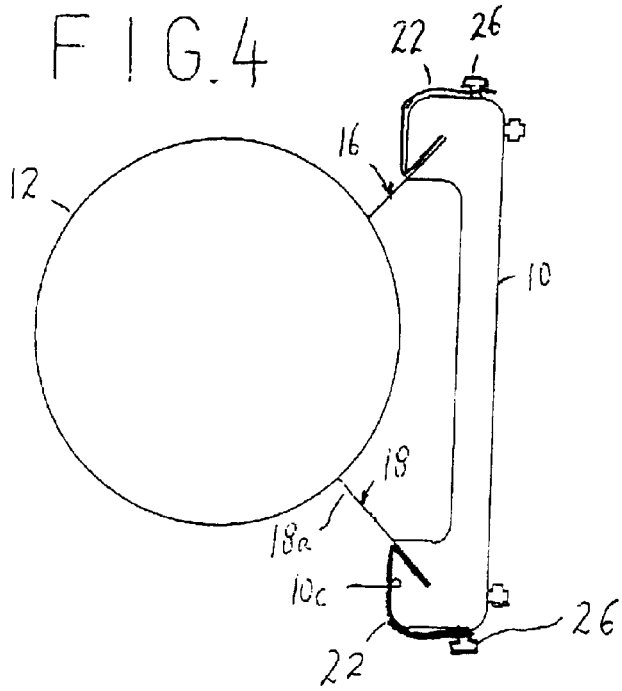
FIG. 5
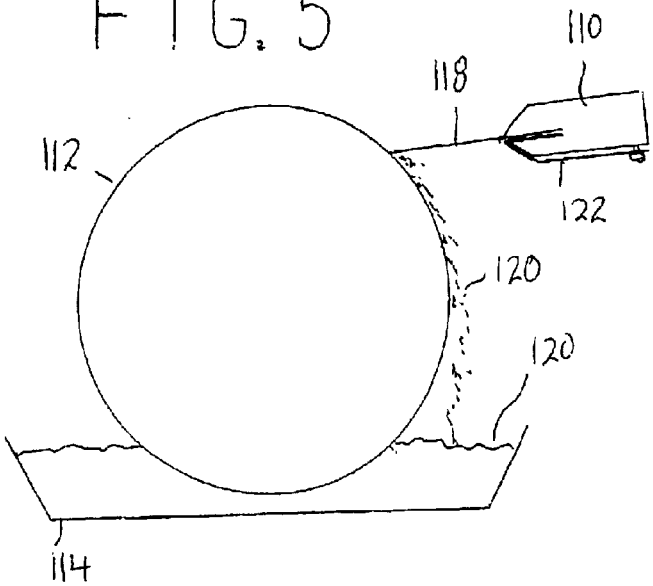

SHIELD FOR DOCTOR BLADE HOLDER

BACKGROUND OF THE INVENTION

The present invention relates generally to printing machines, and more particularly, is directed to a shield for a doctor blade holder.

Conventionally, in printing machines, such as flexographic printing machines, an ink transfer or anilox roll transfers ink to an adjacent plate roll for printing. Ink is supplied to the anilox roll from an ink chamber defined by a chamber housing which partially surrounds the anilox roll. Specifically, ink is supplied through an ink supply tube and then through an ink supply line in the chamber housing, into the ink chamber. In like manner, ink is removed from the ink chamber through an ink return line in the chamber housing and then through an ink return tube.

In order to prevent the escape of ink from the chamber, while ensuring that the ink enters the cells in the anilox roll and has a predetermined thickness on the anilox roll, doctor blades are provided at the entry and exit positions of the anilox roll relative to the ink chamber. The doctor blades are fixed to the chamber housing by a clamp so that the doctor blades overhang the chamber housing and contact the anilox roll.

With this arrangement, the outer surface of the anilox roll passes through the ink chamber and picks up ink for printing. The ink is metered by means of the doctor blades held to the inlet and outlet ends of the chamber housing, with the free ends of the doctor blades being in contact with the outer surface of the anilox roll. The doctor blades are clamped to a chamber housing by a clamp holder.

In such case, ink may leak around the doctor blade and ride on the outer surface of the doctor blade so as to deposit on the outer surface of the chamber housing. Additionally, ink may be deposited on the outside of the chamber by operator error or by a worn doctor blade blowing out. Further, the sealing blade on the chamber may pick up ink from the anilox roll and deposit the ink on the outside of the chamber, an event called back blading. Ink on the outside of the chamber requires an extensive clean-up operation which is burdensome and time-consuming.

Gravure printing has a similar process wherein a doctor blade is held by a clamp or holder. Spills and operator error result in ink being deposited on the clamp or holder, requiring extensive clean up.

OBJECTS AND SUMMARY OF THE INVENTION

Accordingly, it is an object of the present invention to provide a shield for a doctor blade holder that overcomes the aforementioned problems.

It is another object of the present invention to provide a shield for a doctor blade holder that prevents ink droplets from falling on the outer surface of the ink chamber housing or other holder that holds the doctor blade.

It is still another object of the present invention to provide a shield for a doctor blade holder that covers the outer surface of the ink chamber housing or other holder that holds the doctor blade.

It is yet another object of the present invention to provide a shield for a doctor blade holder that prevents ink from falling on the outer surface of the holder or clamp housing.

It is a further object of the present invention to provide a shield for a doctor blade holder which hangs down in covering relation to the outer surface of the ink chamber housing or other holder that holds the doctor blade.

It is a still further object of the present invention to provide a shield for a doctor blade holder which wraps around and is secured to the outer surface of the ink chamber housing or other holder that holds the doctor blade.

It is a yet further object of the present invention to provide a shield for a doctor blade holder in which the shield and doctor blade are secured to each other to form a unitary unit.

In accordance with an aspect of the present invention, for use with a doctor blade holder of a printing machine, a combined doctor blade and shield includes a doctor blade adapted to be secured to the doctor blade holder in a manner so as to extend outwardly therefrom at least substantially in engagement with an outer surface of a roll for metering ink on the roll, the doctor blade being formed as a doctoring plate having a rear portion adapted to be secured to the doctor blade holder and a front portion with a doctoring edge adapted to at least substantially contact the outer surface of the roll to meter ink thereto, and a doctor blade shield having one end fixedly secured to the doctor blade in spaced relation away from the doctoring edge and a second opposite free end unsecured to the doctoring plate, so as to cover at least a portion of the outer surface of the doctor blade holder to prevent ink from depositing on the outer surface of the doctor blade holder when the combined doctor blade and doctor blade shield is clamped to the doctor blade holder.

The shield can be flexible or rigid. In one embodiment, the shield hangs down from the one end in at least partial covering relation to the outer surface of the doctor blade holder. In another embodiment, the shield has a second opposite end secured to the outer surface of the doctor blade holder at a position remote from the one end. In such case, the shield is wrapped at least partially around the outer surface of the doctor blade holder, and there is a securing arrangement on the outer surface of the doctor blade holder for securing the second opposite end of the shield thereto.

In one embodiment, the doctor blade holder is formed as part of an ink chamber housing, and in another embodiment, the doctor blade holder is part of a gravure printing apparatus.

In accordance with another aspect of the present invention, for use with a machine, a combined doctor blade and shield includes a doctor blade formed as a doctoring plate having a rear portion to be secured to a holder of the machine and a front portion with a doctoring edge adapted to at least substantially contact an outer surface of an element to be doctored, and a doctor blade shield having one end fixedly secured to the doctor blade in spaced relation away from the doctoring edge and a second opposite free end unsecured to the doctoring plate, so as to cover at least a portion of an outer surface of the holder when the combined doctor blade and shield is secured to the holder.

In accordance with still another aspect of the present invention, a printing machine includes an ink well positioned adjacent a rotating ink roll; a doctor blade holder positioned adjacent the ink roll; a doctor blade adapted to be secured to the doctor blade holder in a manner so as to extend outwardly therefrom at least substantially in engagement with an outer surface of the ink roll for metering ink on the roll, the doctor blade being formed as a doctoring plate having a rear portion adapted to be secured to the doctor blade holder and a front portion with a doctoring edge adapted to at least substantially contact the outer surface of the roll to meter ink thereto; and a doctor blade shield having one end fixedly secured to the doctor blade in spaced relation away from the doctoring edge and a second opposite free end unsecured to the doctoring plate, so as to cover at least a portion of the outer surface of the doctor blade holder to prevent ink from depositing on the outer surface of the doctor blade holder when the combined doctor blade and doctor blade shield is clamped to the doctor blade holder.

The above and other objects, features and advantages of the invention will become readily apparent from the following detailed description thereof which is to be read in connection with the accompanying drawings.

BRIEF DESCRIPTION OF THE DRAWINGS

FIG. 3 is an end elevational view of the combined doctor blade and shield assembly of FIG. 2;

FIG. 4 is a cross-sectional view of a chamber housing with the combined doctor blade and shield clamped to the chamber housing, according to a modification of the present invention; and FIG. 5 is a cross-sectional view of a gravure printing arrangement with the combined doctor blade and shield clamped to the holder, according to another embodiment of the present invention.

DETAILED DESCRIPTION

Figure 1:
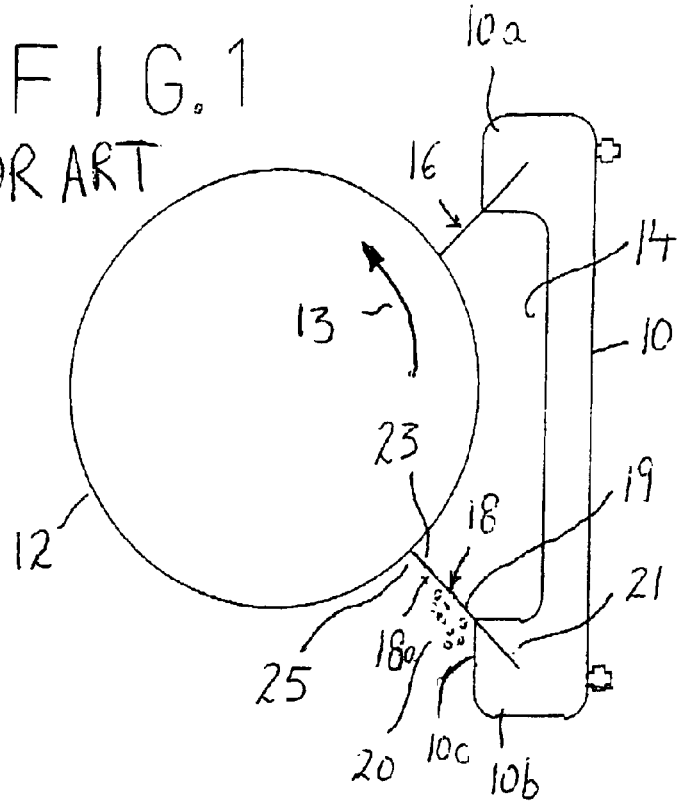
FIG. 1 PRIOR ART
FIG. 1 is a cross-sectional view of a known chamber housing with a conventional doctor blade clamped to the chamber housing.

Referring to the drawings in detail, and initially to FIG. 1 thereof, there is shown a known assembly of a printing machine which includes an ink chamber housing 10 associated with an anilox roll 12. Ink chamber housing 10 includes an ink chamber 14 into which anilox roll 12 extends for receiving ink on the outer surface thereof.

As is well known, an upper doctor blade 16 is connected to one raised end 10*a* of ink chamber housing 10 and contacts or substantially contacts the outer surface of anilox roll 12, while a lower doctor blade 18 is connected with the opposite raised end 10*b* of ink chamber housing 10 and also extends to the outer surface of anilox roll 12 so as to scrape any excess ink therefrom. If the anilox roll rotates in the counter-clockwise direction of arrow 13, the upper doctor blade 16 extends to the outer surface of anilox roll 12 so as to scrape any excess ink therefrom.

Each doctor blade 16 and 18 is formed by a thin doctoring plate 19 having a rear portion 21 to be clamped to ink chamber housing 10 and a front portion 23 with a doctoring edge 25 which contacts or substantially contacts the outer surface of anilox roll 12 to control the level of ink thereon.

Figure 2:
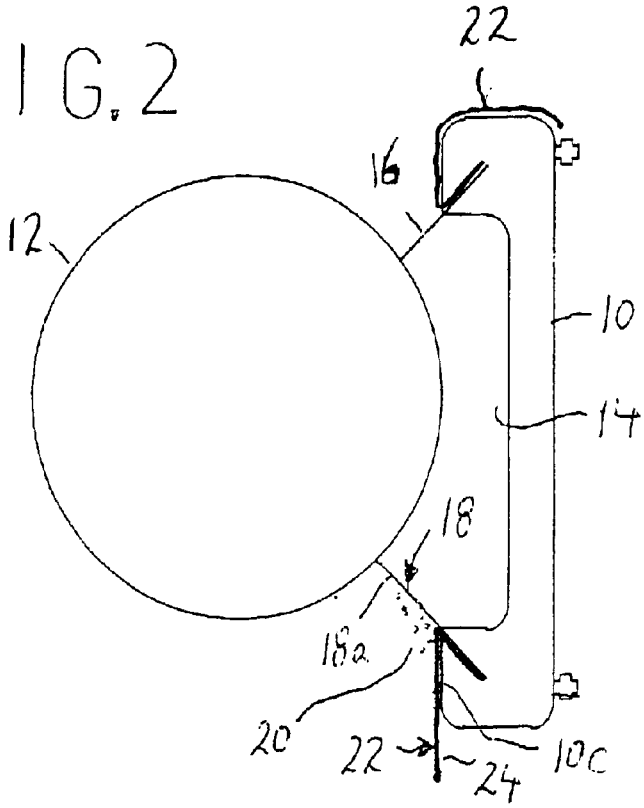
FIG. 2 is a cross-sectional view of a chamber housing with a doctor blade and shield clamped to the chamber housing, according to a first embodiment of the present invention.

Referring to FIGS. 2 and 3, a first embodiment of the present invention is shown in which elements corresponding to the known structure of FIG. 1 are identified by the same reference numerals, and a detailed description of the common elements will be omitted for the sake of brevity.

In this first embodiment of the present invention, a shield 22 in the form of a sheet of material 24 is provided, such that the upper end of shield 22 is directly secured to the lower end of doctor blade 18. This securement can be by any suitable means, such as adhesive, ultrasonic welding, etc. Thus, doctor blade 18 and sheet 22 can be installed and sold as a single unit for replacement, thereby simplifying the overall replacement. This embodiment ensures proper placement of shield 22 in chamber housing 10 since shield 22 is fixed to blade 18. In addition, at the point of sale and for installation purposes, shield 22 can be located so that it covers the sharp doctoring edge of blade 18 so as to protect the operator when blade 18 is being installed in chamber housing 10, and can then be pulled away from the sharp doctoring edge of blade 18 to the position shown in FIG. 2.

Alternatively, shield 22 can be folded until doctor blade 18 is secured to chamber housing 10, and thereafter, unfolded to the position shown in FIG. 2.

The unitary assembly of shield 22 and doctor blade 18 is commonly clamped by a clamping assembly (not shown) of ink chamber 10. The clamping assembly is a well known clamping assembly, and a suitable clamping assembly that can be used is of the type described in U.S. Pat. No. 5,524,540 to the same inventor herein, and the entire patent of which is incorporated herein by reference.

Shield 22 hangs down from doctor blade 18 in covering relation to outer surface 10*c* of chamber housing 10. Shield 22 can have any suitable shape, for example, rectangular, square, circular, etc. With this arrangement, any ink 20 that runs down outer surface 18*a* of doctor blade 18 does not fall onto outer surface 10*c* of chamber housing 10, but rather, deposits on shield 22 and/or runs down shield 22 into a pan (not shown) positioned below the lower end of shield 22. When it is time to change doctor blade 18, shield 22 is replaced as a single unit with doctor blade 18. Shield 22 therefore keeps the outer surface 10*c* of ink chamber 10 clean should any ink leak or back blade from ink chamber 10.

The sheet of material 24 of shield 22 can be made from any suitable material that has a liquid resistant quality, for example, polypropylene, polyethylene, acetate, or other material, and can be rigid or flexible.

In addition, a further shield 22 can be formed as a unitary structure with upper doctor blade 16 as well, as shown in FIG. 2.

Referring to FIG. 4, instead of shield 22 merely hanging down from doctor blade 18, as shown in FIG. 2, the lower end of shield 22 can be wrapped about outer surface 10*c* of chamber 10 and secured to outer surface 10*c* by a securing device 26. The lower end of shield 22 can be secured to outer surface 10*c* of chamber housing 10 by any suitable means, such as clamps, bolts, hooks, snaps, "VELCRO", release adhesive, etc. In like manner, a shield 22 can be provided as well with upper doctor blade 16.

It will be appreciated that the present invention is not limited to use with a chamber doctor blade for an anilox roll, but has much wider applications. For example, in the coating art where a roll of paper or other material is coated with a liquid layer, it is common to use a doctor blade as a smoothing device on the paper. However, the liquid coating layer tends to ride along the doctor blade onto the doctor blade holder. Use of a shield 22 with the doctor blade would prevent this occurrence.

Further, the present invention can be used with a gravure printing operation, as shown in FIG. 5. In such case, a roll 112 rotates in a pan 114 to pick up ink 120. Excess ink picked up by roll 112 is wiped by a doctor blade 118 held in a holder 110. However, the ink often splatters on holder 110. Therefore, in accordance with this modification of the invention, a shield 122 is secured to doctor blade 118 in the same manner as described above, and held by holder 110. The free end of shield 122 is then wrapped about holder 110 and secured at an opposite end of holder 110 by a securing arrangement, such as clamps, bolts, hooks, snaps, "VELCRO", release adhesive, etc.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. For use with a doctor blade holder of a printing machine, a combined doctor blade and shield comprising:

a doctor blade adapted to be secured to the doctor blade holder in a manner so as to extend outwardly therefrom at least substantially in engagement with an outer surface of a roll for metering ink on the roll, the doctor blade being formed as a doctoring plate having a rear portion adapted to be secured to the doctor blade holder and a front portion with a doctoring edge adapted to at least substantially contact the outer surface of the roll to meter ink thereto, and a doctor blade shield having one end permanently secured to the doctor blade at a point of time when the doctor blade is placed in the doctor blade holder, during operation of the doctor blade in the printing machine and when the doctor blade is removed from the doctor blade holder and in spaced relation away from said doctoring edge and a second opposite free end unsecured to said doctoring plate, so as to cover at least a portion of the outer surface of the doctor blade holder to prevent ink from depositing on the outer surface of the doctor blade holder when the combined doctor blade and doctor blade shield is clamped to the doctor blade holder.

2. A combined doctor blade and shield according to claim 1, wherein said shield is flexible.

3. A combined doctor blade and shield according to claim 1, wherein said shield is rigid.

4. A combined doctor blade and shield according to claim 1, wherein said shield hangs down from said one end in at least partial covering relation to the outer surface of the doctor blade holder.

5. A combined doctor blade and shield according to claim 1, wherein said shield has a second opposite end secured to the outer surface of the doctor blade holder at a position remote from said one end.

6. A combined doctor blade and shield according to claim 5, wherein said shield is wrapped at least partially around said outer surface of the doctor blade holder.

7. A combined doctor blade and shield according to claim 5, wherein there is a securing arrangement on the outer surface of said doctor blade holder for securing the second opposite end of the shield thereto.

8. A combined doctor blade and shield according to claim 1, wherein said doctor blade holder is formed as part of an ink chamber housing.

9. A combined doctor blade and shield according to claim 1, wherein said doctor blade holder is part of a gravure printing apparatus.

10. For use with a machine, a combined doctor blade and shield comprising:

a doctor blade formed as a doctoring plate having a rear portion to be secured to a holder of the machine and a front portion with a doctoring edge adapted to at least substantially contact an outer surface of an element to be doctored, and a doctor blade shield having one end permanently secured to the doctor blade at a point of time when the doctor blade is placed in the holder, during operation of the doctor blade in the machine and when the doctor blade is removed from the holder and in spaced relation away from said doctoring edge and a second opposite free end unsecured to said doctoring plate, so as to cover at least a portion of an outer surface of the holder when the combined doctor blade and shield is secured to the holder.

11. A combined doctor blade and shield according to claim 10, wherein said shield is flexible.

12. A combined doctor blade and shield according to claim 10, wherein said shield is rigid.

13. A combined doctor blade and shield according to claim 10, wherein said shield hangs down from said one end in at least partial covering relation to the outer surface of the holder.

14. A combined doctor blade and shield according to claim 10, wherein said shield has a second opposite end secured to the outer surface of the holder at a position remote from said one end.

15. A combined doctor blade and shield according to claim 10, wherein said shield is wrapped at least partially around said outer surface of the holder.

16. A combined doctor blade and shield according to claim 10, wherein there is a securing arrangement on the outer surface of said holder for securing the second opposite end of the shield thereto.

17. A printing machine comprising:

an ink well positioned adjacent a rotating ink roll;

a doctor blade holder positioned adjacent the ink roll;

a doctor blade adapted to be secured to the doctor blade holder in a manner so as to extend outwardly therefrom at least substantially in engagement with an outer surface of the ink roll for metering ink on the roll, the doctor blade being formed as a doctoring plate having rear portion adapted to be secured to the doctor blade holder and a front portion with a doctoring edge adapted to at least substantially contact the outer surface of the roll to meter ink thereto; and a doctor blade shield having one end permanently secured to the doctor blade at a point of time when the doctor blade is placed in the doctor blade holder, during operation of the doctor blade in the printing machine and when the doctor blade is removed from the doctor blade holder and in spaced relation away from said doctoring edge and a second opposite free end unsecured to said doctoring plate, so as to cover at least a portion of the outer surface of the doctor blade holder to prevent ink from depositing on the outer surface of the doctor blade holder when the combined doctor blade and doctor blade shield is clamped to the doctor blade holder.

18. A printing machine according to claim 17, wherein said shield is flexible.

19. A printing machine according to claim 17, wherein said shield is rigid.

20. A printing machine according to claim 17, wherein said shield hangs down from said one end in at least partial covering relation to the outer surface of the doctor blade holder.

21. A printing machine according to claim 17, wherein said shield has a second opposite end secured to the outer surface of the doctor blade holder at a position remote from said one end.

22. A printing machine according to claim 21, wherein said shield is wrapped at least partially around said outer surface of the doctor blade holder.

23. A printing machine according to claim 21, further comprising a securing arrangement on the outer surface of said doctor blade holder for securing the second opposite end of the shield thereto.

24. A printing machine according to claim 17, wherein said doctor blade holder is formed as part of an ink chamber housing.

25. A printing machine according to claim 17, wherein said doctor blade holder is part of a gravure printing apparatus.

* * * * *